US009888333B2

(12) United States Patent
Zurek et al.

(10) Patent No.: US 9,888,333 B2
(45) Date of Patent: Feb. 6, 2018

(54) THREE-DIMENSIONAL AUDIO RENDERING TECHNIQUES

(71) Applicant: GOOGLE TECHNOLOGY HOLDINGS LLC, Mountain View, CA (US)

(72) Inventors: Robert A. Zurek, Antioch, IL (US); Thomas Y. Merrell, Beach Park, IL (US)

(73) Assignee: GOOGLE TECHNOLOGY HOLDINGS LLC, Mountain View, CA (US)

( * ) Notice: Subject to any disclaimer, the term of this patent is extended or adjusted under 35 U.S.C. 154(b) by 334 days.

(21) Appl. No.: 14/319,209

(22) Filed: Jun. 30, 2014

(65) Prior Publication Data

US 2015/0131966 A1 May 14, 2015

Related U.S. Application Data

(60) Provisional application No. 61/902,331, filed on Nov. 11, 2013.

(51) Int. Cl.
*H04S 3/00* (2006.01)

(52) U.S. Cl.
CPC ..... *H04S 3/008* (2013.01); *H04S 2400/11* (2013.01); *H04S 2420/13* (2013.01)

(58) Field of Classification Search
CPC .. H04N 21/8106; H04N 9/802; H04N 9/8211; H04N 9/67; H04S 2400/13
See application file for complete search history.

(56) References Cited

U.S. PATENT DOCUMENTS 7,577,260 B1 * 8/2009 Hooley ..... F41H 13/0081 381/307
7,606,372 B2 10/2009 Melchior
8,743,157 B2 6/2014 Singaraju
9,003,309 B1 * 4/2015 Venkateshamurthy ..... G06F 17/2247 715/760

(Continued)

FOREIGN PATENT DOCUMENTS

WO 2011002729 A1 1/2011

OTHER PUBLICATIONS

Kim et al., "3D Audio Depth Rendering for Enhancing an Immersion of 3DTV," Audio Eng. Soc. Conv. Paper 8522, 131st Convention, New York, NY, Oct. 20-23, 2011.

*Primary Examiner* — Hung Dang
*Assistant Examiner* — Sunghyoun Park
(74) *Attorney, Agent, or Firm* — Morris & Kamlay LLP

(57) ABSTRACT

Three-dimensional (3D) audio content creation and rendering systems and methodologies are presented here. A disclosed method of processing 3D audio assigns audio source objects to 3D video objects, links audio tracks to assigned audio source objects, and performs wave field synthesis on the linked audio tracks to generate 3D audio data representing a 3D spatial sound field. A disclosed method of processing 3D audio during playback of 3D video content obtains 3D audio data and 3D video data for a frame of 3D video content, applies device-specific parameters to the 3D audio data to obtain transformed 3D audio data scaled to a presentation device, and processes the transformed 3D audio data to render audio information for an array of speakers associated with the presentation device.

42 Claims, 5 Drawing Sheets

(56) References Cited

U.S. PATENT DOCUMENTS

| | | | | |
|---|---|---|---|---|
| 2001/0037430 | A1* | 11/2001 | Heo | G11B 27/034 711/112 |
| 2002/0049717 | A1* | 4/2002 | Routtenberg | H04H 60/21 |
| 2003/0053680 | A1* | 3/2003 | Lin | H04S 5/005 382/154 |
| 2006/0038965 | A1* | 2/2006 | Hennes | G03B 21/26 353/94 |
| 2007/0296831 | A1* | 12/2007 | Nozaki | H04N 5/907 348/231.8 |
| 2010/0013653 | A1* | 1/2010 | Birnbaum | G06F 1/1613 340/669 |
| 2010/0094631 | A1* | 4/2010 | Engdegard | G10L 19/008 704/258 |
| 2010/0272417 | A1* | 10/2010 | Nagasawa | H04N 13/0033 386/341 |
| 2010/0328423 | A1 | 12/2010 | Etter | |
| 2011/0086708 | A1* | 4/2011 | Zalewski | G06F 3/017 463/36 |
| 2011/0242305 | A1 | 10/2011 | Peterson | |
| 2012/0105603 | A1 | 5/2012 | Liu et al. | |
| 2013/0321566 | A1* | 12/2013 | Simonnet | G06T 15/04 348/14.16 |
| 2014/0133683 | A1* | 5/2014 | Robinson | H04S 3/008 381/303 |

* cited by examiner

THREE-DIMENSIONAL AUDIO RENDERING TECHNIQUES

TECHNICAL FIELD

Embodiments of the subject matter described herein relate generally to audio and video processing. More particularly, embodiments of the subject matter relate to the rendering and presentation of three-dimensional (3D) audio.

BACKGROUND

Audio and video playback systems are very well known. A number of modern electronic and computer-based devices support playback of audio and/or video content. For example, most portable computer systems (such as laptop computers and tablet computers) support the playback of digital music files, video files, DVD movie content, video game content, and the like. Moreover, some systems support 3D video technologies that present video content in a 3D space such that the viewer perceives images at locations other than the plane of the physical display screen.

Surround sound and 3D audio technologies may also be supported by a variety of systems. Surround sound and virtual surround sound methodologies provide discrete sound sources at different locations relative to the listener, e.g., front left, front right, front center, rear left, and rear right. In contrast to traditional surround sound, 3D audio creates a realistic spatial sound environment for the listener in a manner that does not strictly depend on the positioning of the listener relative to the speakers.

While 3D digital video presentation has advanced over the last several years, the spatial audio representation of that video content has remained an angular spatial representation of the content, rather than a true 3D representation of the content and its movement. 3D video has allowed the perceived image to leave the display screen and move out into the user's environment, but the audio representation is usually held back to the distance of the reproduction transducers and behind. Additionally, the creation of audio content for 3D visual content has remained a very manual artistic expression, rather than an accurate rendition physically tied to the image that is supposed to be producing the sound. Thus, even though 3D video technology allows video objects to "leave" the display screen, the sounds and audio associated with those video objects may not accurately track the virtual positioning within the 3D space.

Accordingly, there is a need for a 3D audio rendering technique that is suitable for use with 3D video content. Furthermore, other desirable features and characteristics will become apparent from the subsequent detailed description and the appended claims, taken in conjunction with the accompanying drawings and the foregoing technical field and background.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

DETAILED DESCRIPTION

Figure 1:
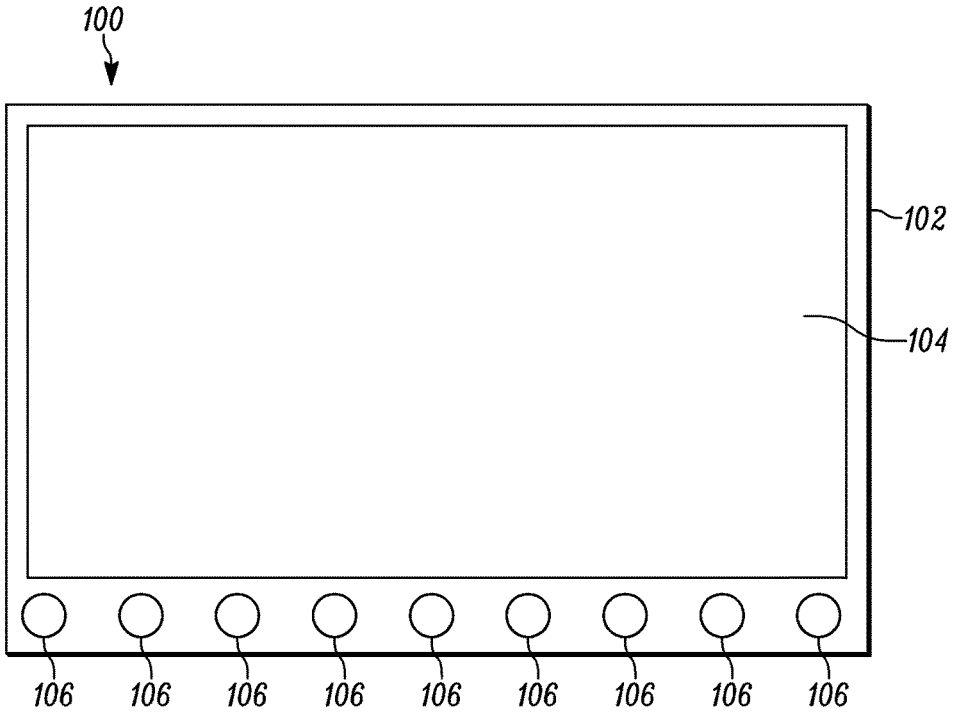
FIG. 1 is a view of a presentation device as perceived from the typical viewing perspective of a user.

The following detailed description is merely illustrative in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over other implementations. Furthermore, there is no intention to be bound by any expressed or implied theory presented in the preceding technical field, background, brief summary or the following detailed description.

The subject matter disclosed here relates to a system and method for cooperatively rendering 3D video and audio in a presentation device (e.g., an electronic computer-based multimedia device such as a portable computer). Also disclosed is a technique for the creation of 3D audio/video content that allows for accurate, automated creation of a virtual sound field.

In accordance with certain embodiments, audio source objects are tied to video objects in virtual 3D space. This audio-to-video object assignment can be accomplished by designating an audio track to each audio source object in a virtual 3D environment such as is provided by the OPENGL, DIRECTX, and similar application programming interfaces. In accordance with the content creation process described here, one or more audio streams are assigned to a 3D video object rather than to an audio channel or to a speaker. For example, a single character voice track may be tied to the object representing the 3D mesh of the video character. As the position of the video object moves in the 3D virtual space, the position of the corresponding audio will also move in that 3D virtual space. This not only allows for positioning of the sound sources, but also for sizing each sound source relative to other objects, thus enabling echoes and other true audio effects to be generated.

Moreover, the material makeup of each object, which is used for lighting effects and physics engines, can be used by the audio creation engine. This includes applying absorption coefficients to the virtual objects in the environment, which enables accurate creation of an in-situ sound field. One shortcoming of trying to reproduce a sound field using normal surround sound techniques is that a distance in front of the reproducing apparatus cannot be accurately emulated. Moreover, the angular change in the size of the sound source cannot be accurately modeled. In this regard, as a 3D virtual object moves closer to a listener, the apparent size of the sound source becomes larger. This effect is readily reproduced through wave field synthesis because the actual spatial sound source is reproduced in the real world playback environment, as opposed to the sound being played back by another source in traditional stereophonic systems. The sound source size is integrated into the model when the sound source is assigned to an object in the virtual space.

The video component is rendered by creating its 2D or 3D representation as seen through a virtual 3D portal, which is realized using the physical hardware display element (the real world physical display is also referred to herein as the 3D "viewport"). The video depth scales with the size of the display screen associated with the presentation system. Accordingly, rendering the video image portion of the content can leverage existing technology and conventional video processing and rendering methodologies. Notably, however, the 3D audio content includes a virtual-to-reality scaling factor that is device-specific. This scaling factor is utilized to ensure that the rendered 3D audio content scales in an appropriate manner with the actual physical size of the 3D viewport. Thus, the extent to which the 3D audio content must be scaled may not be known until playback parameters and configuration settings of the presentation system are known or selected.

In the final rendering for presentation to the user, 3D imagery is created in 2D for a standard display or in 3D for a 3D display, and audio is reproduced in 3D space using wave field synthesis techniques to reproduce the true 3D sound field in the user's viewing/listening area. The audio is reproduced as if its point sources are actually emitting sound from designated locations in 3D space. For example, if the 3D visual representation of a sound-generating video object is one foot in front of the display element, then the transducer (speaker) array of the presentation device is driven such that the emitted sound waves create a point source for that video object, wherein the point source is perceived by the user to be one foot in front of the display element.

Scaling is utilized with the audio rendering because the 3D audio is rendered to the actual scale of the virtual model (i.e., the virtual sound field and the actual sound field have to be the same size). For example, although a video object in the virtual image space may be six feet tall, on a sixty-inch display screen the rendered video object may only be one foot tall, and on a ten-inch display screen the same rendered video object may only be two inches tall. Moreover, the rendered video object may be three feet in front of the viewport in the virtual space, but would only appear six inches in front of a sixty-inch display screen, and only one inch in front of a ten-inch display screen. If the sound field were created such that the sound source is always three feet in front of the display, then the user experience would be disjointed in many presentation scenarios (where the size of the display screen results in a virtually scaled environment that is inconsistent with the generated 3D audio).

Accordingly, the 3D audio processing technique described here scales the virtual audio space in accordance with the virtual object space, and based on the dimensions of the display screen utilized by the presentation device, such that the acoustic source position aligns with the perceived visual object position. This results in a congruous experience for the user. Even though the video rendering is screen size agnostic, the audio rendering depends on the relation of the physical screen size to the virtual 3D portal to align the video and audio objects. One scaling approach involves recording different "versions" of the content for individual hardware configurations. This solution, however, requires large amounts of storage space and large bandwidth for transfer. A much more efficient and practical approach (as described here) stores the audio data based on the individual 3D video objects to allow the host system to perform wave field synthesis calculations on the fly as needed. By performing the wave field synthesis calculation in the playback device, not only can the scaling issue of the source be accommodated, but also the wave field synthesis array can vary from playback device to playback device for the optimal sound reproduction for that size device while using the same content. This allows the designer of each device to overcome the challenges of spatial aliasing and ideal component sound source creation for any size display screen. For example, while a ten-inch display screen may utilize ten transducers in a linear array to produce an acceptable amount of spatial aliasing, a sixty-inch display screen may require sixty transducers to achieve the same results.

Turning now the drawings, FIG. 1 is a view of a presentation device 100 as perceived from the typical viewing perspective of a user. The presentation device 100 may be any suitably configured component that includes the hardware, software, firmware, processing logic, memory, and other elements as needed to support the audio and video processing techniques and methodologies described herein. The presentation device 100 shown in FIG. 1 is realized as a tablet computer having a primary housing 102, a display element 104 (also referred to herein as a "display" or a "screen") that is integrated with the housing 102, and an array of speakers 106 integrated with the housing 102. Although not always required, the display element 104 represents the majority of the front surface of the presentation device 100, and the speakers 106 are configured such that they emit sound from the front surface of the presentation device 100. The illustrated embodiment includes a simple linear array of nine speakers 106 positioned along one horizontal edge of the housing 102. In alternative implementations, the array of speakers 106 may include any number of individual speakers arranged elsewhere on the housing 102. For example, additional speakers 106 could be located along the top, bottom, left edge, and/or right edge of the display element 104. Notably, the array of speakers 106 is designed and configured to accommodate a typical use case where an individual user views video content on the display element 104 while positioned centrally and directly (or nearly directly) in front of the display element 104. This typical orientation and configuration places the user in the valid area for wave field synthesis.

Although the 3D audio techniques described here can be executed by any suitably configured system or device, tablet media devices and laptop computers are preferred presentation devices because audio/video content is typically consumed by an individual who is positioned in front of the device, and that individual usually remains in a desired location that is valid for purposes of wave field synthesis. Moreover, auto stereoscopic displays or passive 3D displays will also influence the viewing angle of the user, thus keeping the user in the desired sound field position. That said, the 3D audio techniques described here can be scaled to accommodate host presentation devices that may have a larger or smaller display element than that usually found on a tablet computer or a laptop computer. For instance, the 3D audio techniques can also be ported for use with miniature tablet devices, large smartphone devices, desktop computer systems, television systems, projection screen monitors, and the like. Moreover, although the disclosed 3D rendering and presentation techniques may not be as effective or pronounced in large scale applications (e.g., movie theaters or large home entertainment systems), they could be utilized in such deployments if so desired. Any specific reference to tablet or laptop computer devices is not intended to limit or restrict the scope or application of the concepts presented here.

Furthermore, although the housing 102 of the presentation device 100 maintains the display element 104 and the array of speakers 106 in fixed positions relative to one another, an alternative embodiment could employ physically distinct speakers and/or a physically distinct display element (as long as the relative locations and dimensions are known for purposes of scaling and audio processing). In this regard, separate speaker units could be positioned on a desktop near a computer monitor, and the physical parameters could be input into the presentation system during an initial setup or calibration routine. The exemplary tablet computer embodiment described here is more straightforward to support because the physical dimensions and arrangement of the display element 104 and the array of speakers 106 are known parameters that do not change over time.

The presentation device 100 is suitably configured to support the creation and playback of 3D audio/video content. In certain preferred embodiments, the presentation device 100 supports real-time content creation and playback of the type that is normally associated with video game applications. In this regard, the presentation device 100 responds (in an interactive and dynamic frame-by-frame manner) to user commands and control inputs, the current game status, and the software instructions that govern game play. Alternatively (or additionally), the presentation device 100 may also support 3D audio/video playback of prerecorded content, such as digital video files, DVD content, or the like.

Figure 2:
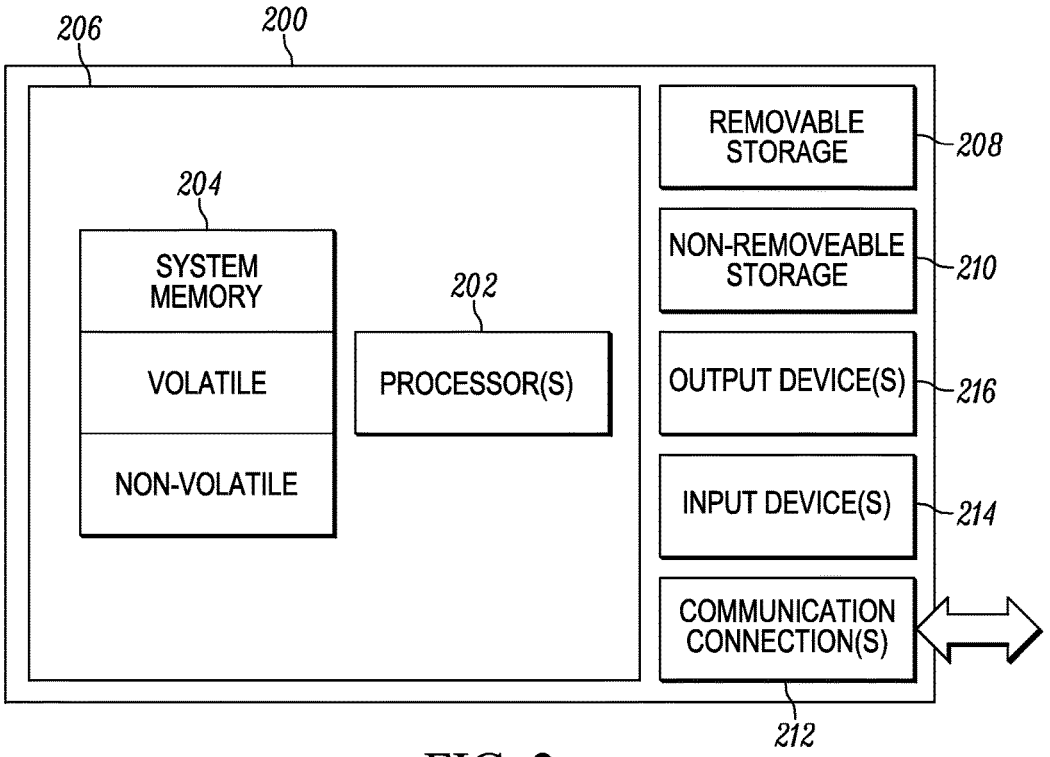
FIG. 2 is a simplified schematic representation of an exemplary presentation device, which may be configured to support 3D audio and 3D video.

In practice, the presentation device 100 can leverage conventional computer architectures, platforms, hardware, and functionality. Those skilled in the art will understand that modern computer devices, smartphones, and video game systems utilize conventional processor-based technologies. In this regard, FIG. 2 is a simplified schematic representation of an exemplary presentation device 200 that is suitable for implementing the 3D audio/video processing techniques described herein.

The presentation device 200 is only one example of a suitable operating environment and is not intended to suggest any limitation as to the scope of use or functionality of the inventive subject matter presented here. Other well-known computing systems, environments, and/or devices that may be suitable for use with the embodiments described here include, but are not limited to, personal computers, server computers, hand-held or laptop devices, multiprocessor systems, microprocessor-based systems, network PCs, minicomputers, mainframe computers, distributed computing environments that include any of the above systems or devices, and the like.

The presentation device 200 and the functions and processes supported by the presentation device 200 may be described in the general context of computer-executable instructions, such as program modules, executed by the presentation device 200. Generally, program modules include routines, programs, objects, components, data structures, and/or other elements that perform particular tasks or implement particular abstract data types. Typically, the functionality of the program modules may be combined or distributed as desired in various embodiments.

The presentation device 200 typically includes at least some form of computer readable media. Computer readable media can be any available media that can be accessed by the presentation device 200 and/or by applications executed by the presentation device 200. By way of example, and not limitation, computer readable media may comprise tangible and non-transitory computer storage media. Computer storage media includes volatile, nonvolatile, removable, and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can accessed by the presentation device 200. Combinations of any of the above should also be included within the scope of computer readable media.

Referring again to FIG. 2, in its most basic configuration, the presentation device 200 typically includes at least one processor 202 and a suitable amount of memory 204. Depending on the exact configuration and type of platform used for the presentation device 200, the memory 204 may be volatile (such as RAM), non-volatile (such as ROM, flash memory, etc.) or some combination of the two. This most basic configuration is identified in FIG. 2 by reference number 206. Additionally, the presentation device 200 may also have additional features/functionality. For example, the presentation device 200 may also include additional storage (removable and/or non-removable) including, but not limited to, magnetic or optical disks, tape, or removable solid state memory such as a Secure Digital (SD) card. Such additional storage is represented in FIG. 2 by the removable storage 208 and the non-removable storage 210. The memory 204, removable storage 208, and non-removable storage 210 are all examples of computer storage media as defined above.

The presentation device 200 may also contain communications connection(s) 212 that allow the presentation device 200 to communicate with other devices. For example, the communications connection(s) could be used to establish data communication between the presentation device 200 and devices or terminals operated by developers or end users, and to establish data communication between the presentation device 200 and one or more networks (e.g., a local area network, a wireless local area network, the Internet, and a cellular communication network). The communications connection(s) 212 may also be associated with the handling of communication media as defined above.

The presentation device 200 may also include or communicate with various input device(s) 214 such as a keyboard, a mouse or other pointing device such as a trackball device or a joystick device, a pen or stylus, a voice input device, a touch input device such as a touch screen display element, a touchpad component, etc. The presentation device 200 may also include or communicate with various output device(s) 216 such as a display element, an array of speakers, a printer, or the like. All of these devices are well known and need not be discussed at length here.

The hardware, software, firmware, and other elements of the presentation device 200 cooperate to support audio and video processing, rendering, and playback (presentation). In this regard, the presentation device 200 can leverage any number of conventional and well-documented audio/video processing, rendering, and presentation techniques, technologies, algorithms, and operations. For example, the presentation device 200 may include or cooperate with any or all of the following components, without limitation: a sound card; a video or graphics card; a graphics processing unit (GPU); and other devices or components commonly found in gaming computer systems. Such common and well-known aspects of the audio/video functionality of the presentation device 200 will not be described in detail here.

The following example assumes that the 3D audio/video content handled by the presentation device 200 is video game content that is dynamic and interactive in nature. Thus, at least some of the frame-by-frame audio/video content is created in real-time during game play (in response to user commands, controls, and interaction with the video game). As is well understood by those familiar with video game technology, each video frame is created and rendered in response to the current game state, previously displayed video frames, user input, etc. Moreover, each frame of video content will usually have associated audio content. Accordingly, the video game software instructions control the audio/video operation of the presentation device 200 such that 3D audio and 3D video data is created for each video frame to be displayed.

In accordance with the exemplary embodiment described here, the 3D audio and 3D video data is generated in a normalized manner that is agnostic of certain device-specific configuration parameters (e.g., the size of the display element used by the presentation device 200, the number of speakers used by the presentation device 200, the arrangement and orientation of the speakers used by the presentation device 200, etc.). Thus, the 3D content creation functionality of the presentation device 200 can be realized with software instructions that are written in a device-agnostic manner. The normalized 3D audio/video data can then be processed and rendered as needed for purposes of playback on the presentation device 200. As explained in more detail below, the normalized 3D audio data may be subjected to at least one transformation that scales the 3D sound field in accordance with the particular size of the display element.

It should be appreciated that the 3D audio methodology described herein could also be utilized in conjunction with a 2D video representation. Moreover, the 3D audio methodology described herein need not be limited to video game applications. In this regard, the described subject matter may also be implemented to support interactive or traditional video playback applications, e.g., playback of digital video files, playback of streaming video content, playback of recorded DVD content, or the like. For a prerecorded application (such as a DVD having a 3D movie stored thereon), the 3D audio content can be generated and stored on nonvolatile media. During playback, however, the stored information can be extracted and processed for purposes of device-specific transformation and scaling as mentioned above. In other words, the content playback methodology remains the same whether the 3D audio data is generated on the fly (as with a video game application) or is stored in prerecorded fashion on a data storage media (as with a DVD or other digital storage application).

Figure 3:
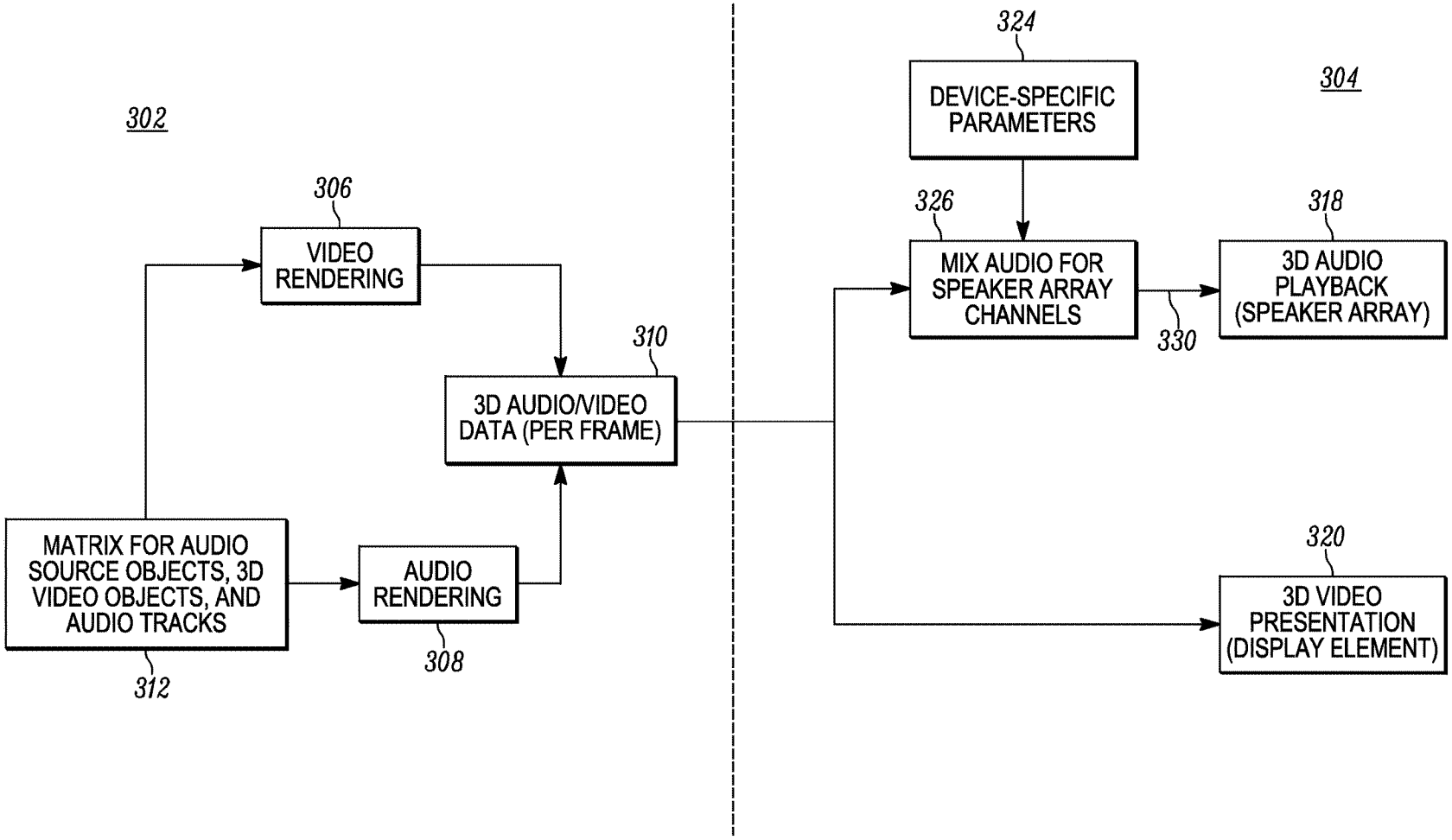
FIG. 3 is a schematic diagram that illustrates exemplary functionality related to 3D audio content creation and playback.

FIG. 3 is a schematic diagram that conceptually illustrates certain functionality related to 3D audio content creation and playback. The dashed line in FIG. 3 is intended to represent the demarcation between content creation functionality 302 (on the left side of FIG. 3) and content playback functionality 304 (on the right side of FIG. 3). For the video game application described here, both the content creation functionality 302 and the content playback functionality 304 are resident at the host presentation device. It should be noted that a practical implementation of a content creation device will include additional functionality and features that are not depicted on the left side of FIG. 3. Likewise, a practical implantation of a content playback device will include additional functionality and features that are not depicted on the right side of FIG. 3.

The content creation functionality 302 is responsible for the creation of the 3D video content and for the creation of the 3D audio content for each frame. Thus, the content creation functionality 302 is shown with a video rendering module 306 and an audio rendering module 308. The video rendering module 306 generates the 3D video data that forms a part of the per-frame 3D audio/video data 310. Similarly, the audio rendering module 308 generates the 3D audio data that forms a part of the per-frame 3D audio/video data 310. In accordance with the exemplary embodiment described here, the content creation functionality 302 maintains and/or cooperates with a suitably formatted audio-to-video matrix 312 or database structure that is utilized to link the 3D audio content to the 3D video content.

In connection with the content creation functionality 302, audio source objects are assigned, linked, or otherwise tied to 3D video objects that appear in the 3D video content to be presented. The audio-to-video matrix 312 is created and maintained to define these relationships. In this regard, a displayed video character (such as an animal, a person, or a monster) could have any number of audio source objects assigned thereto, including zero. For example, many visual elements in a video game or a movie do not generate sound and do not interact with other video objects in a way that creates sound. Consequently, those video objects need not have any audio source objects linked thereto. As another example, a relatively simple visual item (such as an alarm clock or a telephone) might have one and only one audio source object assigned thereto. In contrast, a complex video character may have a plurality of distinct and separate audio source objects linked thereto. For example, a video representation of a monster may have the following audio source objects assigned thereto: a first audio source object corresponding to the voice of the monster; a second audio source object corresponding to the feet of the monster; and a third audio source object corresponding to a bell worn by the monster. Accordingly, a given visual item, character, or element may be defined by one or more distinct 3D video objects, and any number of those 3D video objects could be configured or defined such that they have respective audio source objects assigned thereto. Moreover, a given visual item could have one or more generic, reserved, or unassigned audio source objects assigned thereto, to contemplate game play scenarios, object interactions, or audio/video content states that might result in the creation of audio, e.g., a sound effect.

The audio-to-video matrix 312 is created such that it defines the relationships and assignments between the 3D video objects and the 3D audio source objects for the given audio/video content. In addition, the audio-to-video matrix 312 defines the relationships and correspondence between the 3D audio source objects and the respective audio tracks that are assigned to the 3D audio source objects. In this regard, each audio track represents the sound to be generated in association with the 3D audio source object to which that particular audio track is assigned. It should be understood that a different audio track could be used for each 3D audio source object, resulting in a one-to-one correspondence. Alternatively, the same audio track could be assigned to a plurality of different 3D audio source objects, resulting in a one-to-many correspondence (i.e., an audio track could be reused if so desired). For example, an audio track that represents the sound of wind blowing through a tree could be assigned to fifty different 3D audio source objects, which in turn correspond to fifty different visual tree objects. Even though the same source audio track is utilized, the spatial diversity of the fifty trees within the 3D virtual space will result in blended 3D soundscape during playback.

Accordingly, the audio-to-video matrix 312 may contain entries that link the audio tracks to the 3D audio source objects, and that link the 3D audio source objects to the 3D video objects. In this way, the audio tracks are assigned to the 3D video objects. For prerecorded content, the matrix 312 could be static in nature. For dynamic video game content, however, the matrix 312 is dynamic in many cases, as new characters or objects enter the game playing scenario. In either situation, a different matrix 312 may be loaded for each scene for memory conservation purposes. Notably, the assignment of audio tracks to 3D video objects enables the host system to generate a 3D audio sound field having acoustic characteristics and artifacts that "follow" the 3D representation of the displayed video objects. The resulting 3D audio source objects can be conceptualized as point sources for their audio tracks, such that the point sources actually move within the environment in a manner that corresponds to the movement of the virtually displayed video content. Thus, each 3D audio track and its corresponding audio wave field is generated and rendered independently. The different 3D audio tracks are then processed and mixed for playback using the array of speakers used by the host presentation device. Consequently, each individual speaker element could be used to generate sound that contributes to the synthesized 3D wave field for one or more 3D audio tracks linked to one or more 3D video objects.

In certain embodiments, the audio rendering module 308 performs wave field synthesis on the audio tracks that have been linked to the audio source objects. In this context, wave field synthesis ultimately results in the creation of audio channels corresponding to the speakers of the host presentation device. When the speakers are driven in this manner, they create sound waves that appear to originate from virtual sound sources (e.g., the 3D audio source objects). Thus, wave field synthesis techniques can be employed to create an actual 3D sound field that does not rely on the seating or viewing position of the user. Rather, wave field synthesis results in virtual sound sources that correspond to the virtual 3D positions of the linked video objects, and the localization of the virtual sound sources does not change with the listener's position relative to the presentation device, the display element, or the speaker array.

The content creation functionality 302 may leverage any suitable wave field synthesis methodology, algorithm, or technology as appropriate to the particular embodiment. Although wave field synthesis technology is somewhat immature at the time of this disclosure, those skilled in the art will appreciate that the audio rendering module 308 can be suitably configured as needed for compatibility with any currently known methodology and/or for compatibility with any wave field synthesis technology developed in the future. In this regard, examples of different configurations for wave field synthesis using planar, linear, and circular arrays of speakers can be found in Spors et al., "The Theory of Wave Field Synthesis Revisited" (Paper No. 7358 presented at the 124th Convention of the Audio Engineering Society, May 2008).

For this particular embodiment, the 3D audio/video data 310 for each frame includes, without limitation: the rendered 3D video data generated by the video rendering module 306; the 3D audio data generated by the audio rendering module 308 (i.e., the audio information for each audio track); audio location parameters for each audio track; and a normalized screen size transform. The actual number of audio tracks to be rendered may (and typically will) vary from frame to frame, depending on the current state, conditions, dynamic interactions, number of displayed video objects, etc. Moreover, a video frame may be associated with silence or no rendered audio.

While the depth of the 3D image naturally scales with the screen size it is displayed on, this same is not true for the depth and width of the audio image. The video is rendered by creating its 2D or 3D representation as seen through a virtual viewport. Since the video depth will scale with the size of the view-screen that the user is viewing it on, rendering of the image portion of the content will remain unchanged and use current methods known in the art. The audio, on the other hand, has to include a scaling factor that is not fully known until the hardware that the content is being played back on is selected.

The reason that a scaling factor is utilized in the audio rendering is that the audio is rendered to the actual scale of the model (i.e., the virtual sound field and the actual sound field are preferably generated to be the same size). While the object in the virtual image space may be six feet tall, on a 60-inch display it may be only one foot tall, and on a 10-inch display it may be only two inches tall. Moreover, the object may be three feet in front of the viewport in the virtual space, but it would appear six inches in front of the display on a 60-inch display and one inch in front of a 10-inch display. If the sound field were created such that the sound source is three feet in front of the display, the user experience would be disjointed.

Therefore, in preferred embodiments the virtual audio space is scaled versus the virtual object space based on display size such that the acoustic source position aligns with the perceived visual object position, resulting in a congruous experience for the user. The video rendering is screen size agnostic, however the audio rendering depends on the relation of the physical screen size to the viewport to align the objects. One way of doing this would be to record the content for individual hardware configurations. This solution would, however, require large amounts of storage space and large bandwidth for transfer. A much more efficient method is to store the audio based on individual objects and to perform the wave field synthesis calculations on the fly in the playback system. By performing the wave field synthesis calculation in the playback device, not only can the scaling issue of the source be accommodated, but also the wave field synthesis array can vary from playback device to playback device for the optimal sound reproduction for that size device while using the same content. This allows the designer of each device to overcome the challenges of spatial aliasing and ideal component sound source creation for any size display. In certain hardware embodiments, a 10-inch display may utilize ten transducers in a linear array to produce an acceptable amount of spatial aliasing, whereas in other hardware embodiments a 60-inch display could require 60 transducers to achieve the same results.

The audio playback will therefore employ a device dependent screen size transformation (SST) for every unique physical screen size. The way in which this is embodied is via a normalized screen size transformation (NSST) that, when multiplied by the screen size of the playback device, will result in the device's specific SST. The scaling factor for the screen size transform is equal to the width of the physical screen divided by the distance that the horizontal frustum angle subtends at the 3D zero plane in units of the view space (eyespace). The real acoustic sound field is dimensioned by transforming the view space by the screen size transform. This will translate the distance and size of objects from one another and the user from the view space to the real world scaled appropriately for the user's actual screen size. The normalized screen size transform is then the scaling factor that is equal to the width of a unit screen size (i.e., one inch or one meter) divided by the distance that the horizontal frustum angle subtends at the 3D zero plane in units of the view space (eyespace). According to this definition, the SST for a given display is then the NSST multiplied by the actual display width. The NSST and SST are single scalar quantities that define the relationship between the virtual viewpoint and the real life viewpoint of the end user. The NSST is calculated in the audio rendering module 308 using information from the audio-to-video matrix 312 and the video rendering module 306. The normalized screen size transform changes with the size of the virtual 3D portal (i.e., zooming in or zooming out of the video content). Consequently, the normalized screen size transform may be updated from one frame to another. For this reason, the 3D audio/video data 310 for each frame will include or otherwise convey the current instantiation of the normalized screen size transform.

For the embodiments described here, the "screen size" refers to the width of the screen. In other embodiments, however, the "screen size" may refer to the height of the screen, the diagonal screen dimension, or some other measurable dimension of the display.

For video game and other applications where the 3D audio/video content is created and presented in a real-time ongoing manner, the 3D audio/video data 310 can be written to RAM of the host presentation device such that the 3D audio/video data 310 for the current frame is immediately available for any further processing that is needed for playback. This allows the content creation functionality 302 to concurrently create the 3D audio/video data for at least the next frame. Accordingly, the content creation functionality 302 and the content playback functionality 304 may be resident at the same host presentation device. For stored content applications (such as multimedia files, DVD or Blu-Ray storage discs, or streaming media) where the 3D audio/video content is generated and stored for on-demand or time delayed playback, the 3D audio/video data 310 can be written to a non-volatile memory element or storage media, to a master file, or the like. This allows the created 3D audio/video content to be further processed if necessary so that it can be saved for subsequent playback. In such applications, the 3D audio/video data 310 is created and saved on a frame-by-frame basis even though the actual audio and video content need not be immediately processed for playback. Accordingly, in certain embodiments the content creation functionality 302 may reside at one system or device, while the content playback functionality 304 resides at a distinct and separate presentation device or system.

Referring now to the right side of FIG. 3, the content playback functionality 304 is responsible for processing the 3D audio/video data 310 and driving the display element and the speakers of the host presentation device in a way that is dictated by the processed 3D audio/video data 310. The content playback functionality 304 operates on the current frame of 3D audio/video data 310, which may be created and written to memory in the manner described above. FIG. 3 depicts a 3D audio playback module 318 (which is associated with the speaker array of the presentation device) and a 3D video presentation module 320 (which is associated with the display element of the presentation device). In accordance with certain embodiments, the content playback functionality 304 may also utilize or cooperate with device-specific parameters 324, which in turn can be used by an audio mixing module 326.

The 3D video presentation module 320 processes the current frame of 3D video data using one or more conventional video processing methodologies. The 3D video presentation module 320 is suitably configured to drive the display element (or multiple display elements) associated with the host presentation device. Thus, the 3D video content for the current frame is displayed for viewing by the user. Notably, 3D graphics automatically scale to accommodate the size of the display screen, because 3D video objects are created to appear at a virtual location that is in front of (or behind) the display screen; the specific virtual location is defined as a percentage of the actual display screen size. Accordingly, the 3D video data need not be subjected to any transformation or scaling to accommodate the physical dimensions of the display element.

The content playback functionality 304 also handles the current frame of 3D audio data concurrently with the processing of the current frame of 3D video data, such that the current frame of 3D audio data is presented to the user in a way that is synchronized with the display of the current frame of 3D video data. In accordance with certain preferred embodiments, the audio mixing module 326 receives or otherwise accesses the current frame of 3D audio data and other portions of the 3D audio/video data 310 that may be necessary to process and generate the 3D audio wave fields for the current video frame. The additional information handled by the audio mixing module 326 may include, without limitation, the normalized screen size transform for the current frame, and 3D location parameters for each audio track of the current frame. As depicted in FIG. 3, the audio mixing module 326 also obtains or accesses the device-specific parameters 324 for the host presentation device, such as display size.

The 3D audio data created by the content creation functionality 302 represents the 3D spatial sound field in a manner that is independent of the physical display screen dimensions of the host presentation device, and in a manner that is independent of the particular speaker configuration, layout, and arrangement utilized by the host presentation device. Similarly, the normalized screen size transform conveyed by the 3D audio/video data 310 is calculated based on the dimensions of the virtual 3D portal as defined by the 3D video content, and the normalized screen size transform is calculated in a manner that is independent of the physical display screen dimensions and the speaker configuration of the host presentation device. Accordingly, the device-specific parameters 324 enable the content playback functionality 304 to adjust, transform, and scale the normalized 3D audio data as needed to accommodate the particular hardware configuration of the host presentation device. The scaling of the 3D audio is important to preserve the realistic linking of the 3D audio to the 3D video from one presentation device to another.

The device-specific parameters 324 define, identify, estimate, or otherwise characterize the physical screen size of the host presentation device. Thus, the device-specific parameters 324 may indicate, without limitation: the diagonal display dimension (in inches, centimeters, or any desired units); the height and width dimensions; the height and width pixel resolution; or the like. The device-specific parameters 324 also define, identify, estimate, or otherwise characterize the speaker configuration for the array of speakers used by the host presentation device. For example, the device-specific parameters 324 may indicate, without limitation: the number of individual speakers contained in the array of speakers; the positions or locations of the speakers relative to each other and/or relative to a known reference point or position; the shape of each speaker; the size of each speaker; the frequency response of each speaker; any applicable crossover points of each speaker; or the like.

In some practical scenarios, the device-specific parameters 324 are predetermined and known by the host presentation device itself. For example, if the presentation device is a tablet computer or a laptop computer, then the native display and speaker configurations can be utilized. Alternatively, the device-specific parameters 324 could be defined in response to the user connecting an external monitor and/or an external speaker array. In other situations, the device-specific parameters 324 are determined and saved in association with an initialization or setup procedure. For example, the device-specific parameters 324 could be saved in response to user inputs or selections that are collected when video game software is installed, when a DVD is inserted for playback, or the like.

The audio mixing module 326 processes the 3D audio data, the 3D audio location information, and the normalized screen size transform for the current frame. The processing performed by the audio mixing module 326 is influenced by the device-specific parameters 324, and the processing scales the 3D audio data in a manner that is appropriate for the host presentation device. The output 330 of the audio mixing module 326 represents the transformed 3D audio data that has been rendered for the array of speakers used by the presentation device. Notably, the processing carried out by the audio mixing module 326 results in a respective channel of audio information for each speaker in the array of speakers. In this regard, the audio mixing module 326 may calculate an audio mixing matrix for each speaker contained in the array of speakers, and render audio information for each speaker in accordance with the audio mixing matrix.

For the illustrated example, the output 330 corresponds to the audio signals that are used to drive the individual speakers for purposes of generating sound that accompanies the 3D video presentation. The 3D audio playback module 318 may include or cooperate with the array of speakers. Thus, the 3D audio playback module 318 drives the array of speakers based on the output 330. As explained above, the user will experience sound that appears to emanate from the 3D video objects, wherein the sound sources move and track the virtual 3D location of the corresponding 3D video objects. The wave field synthesis technique phases the array of speakers such that the real world sound sources (which are tied to the 3D video objects) appear to move within the actual viewing environment and such that the sound sources may appear to be generated from spatial locations other than the true physical locations of the individual speakers. In other words, the sound pressure levels measured in the viewing environments will appear to emanate from the virtual 3D audio point sources.

Figure 4:
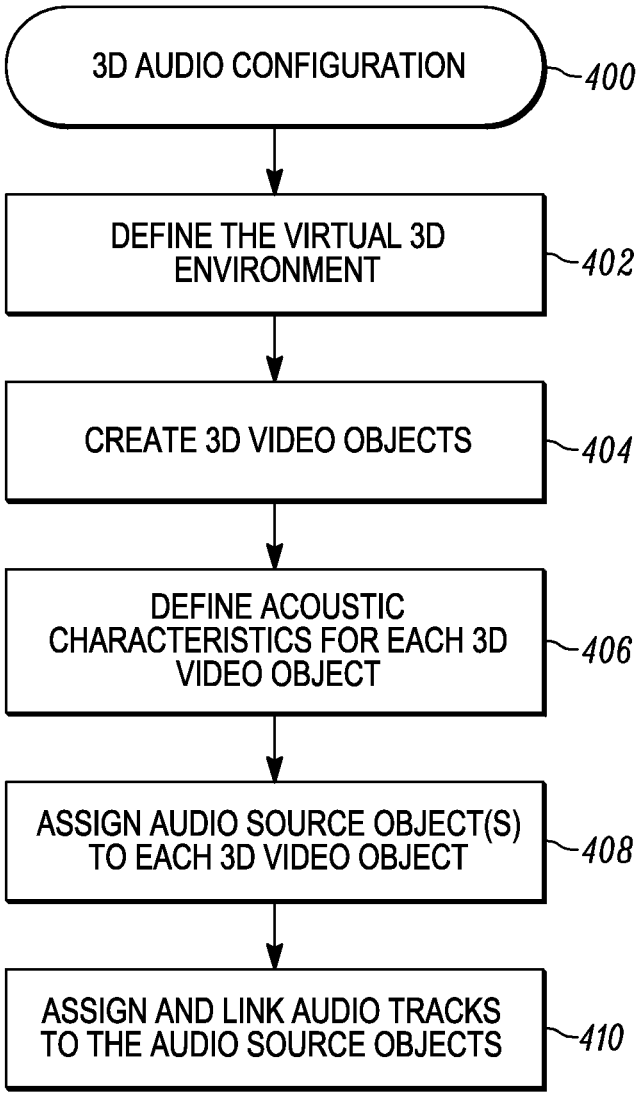
FIG. 4 is a flow chart that illustrates an exemplary embodiment of a 3D audio configuration process.
Figure 5:
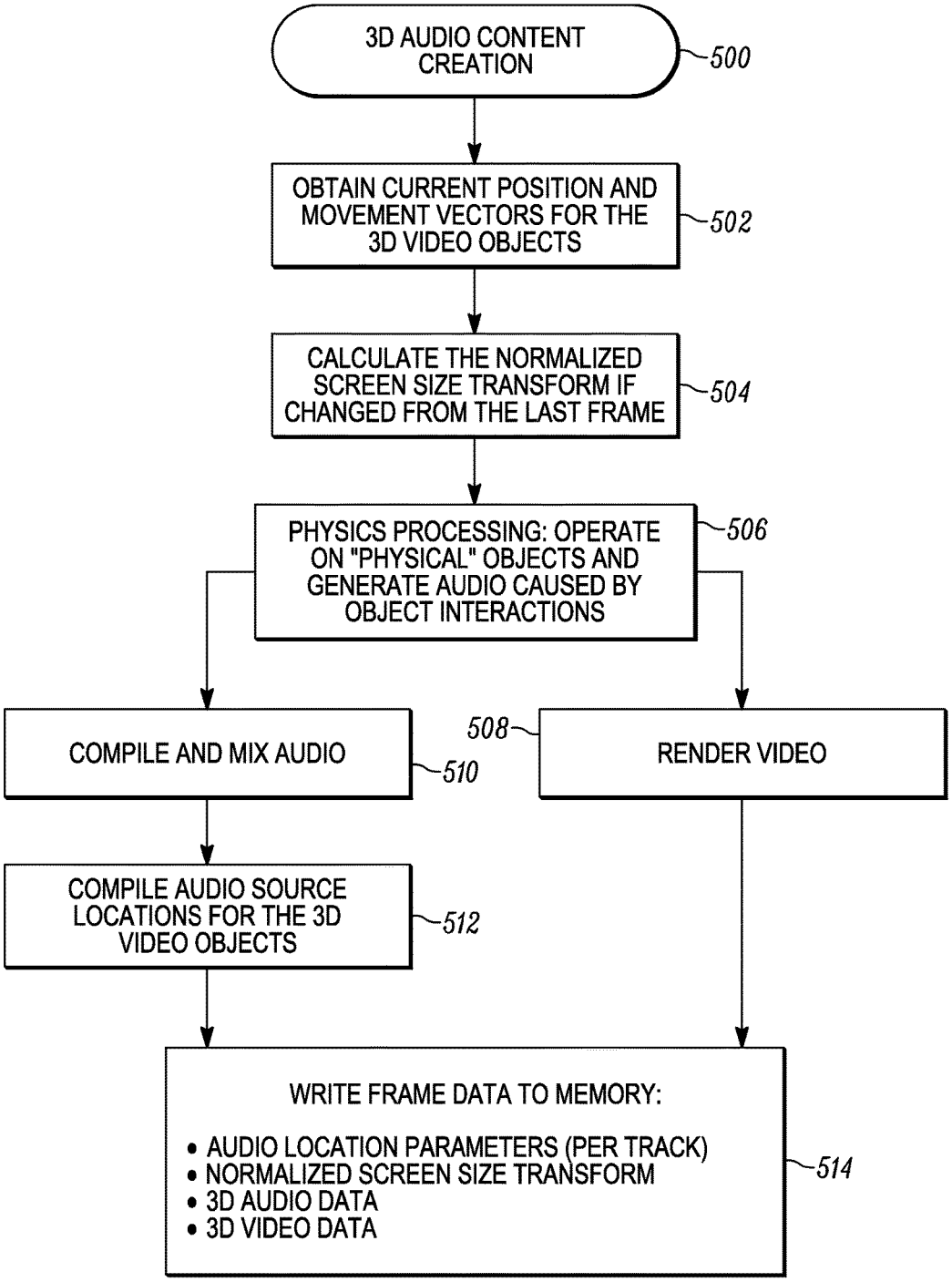
FIG. 5 is a flow chart that illustrates an exemplary embodiment of a 3D audio content creation process.
Figure 6:
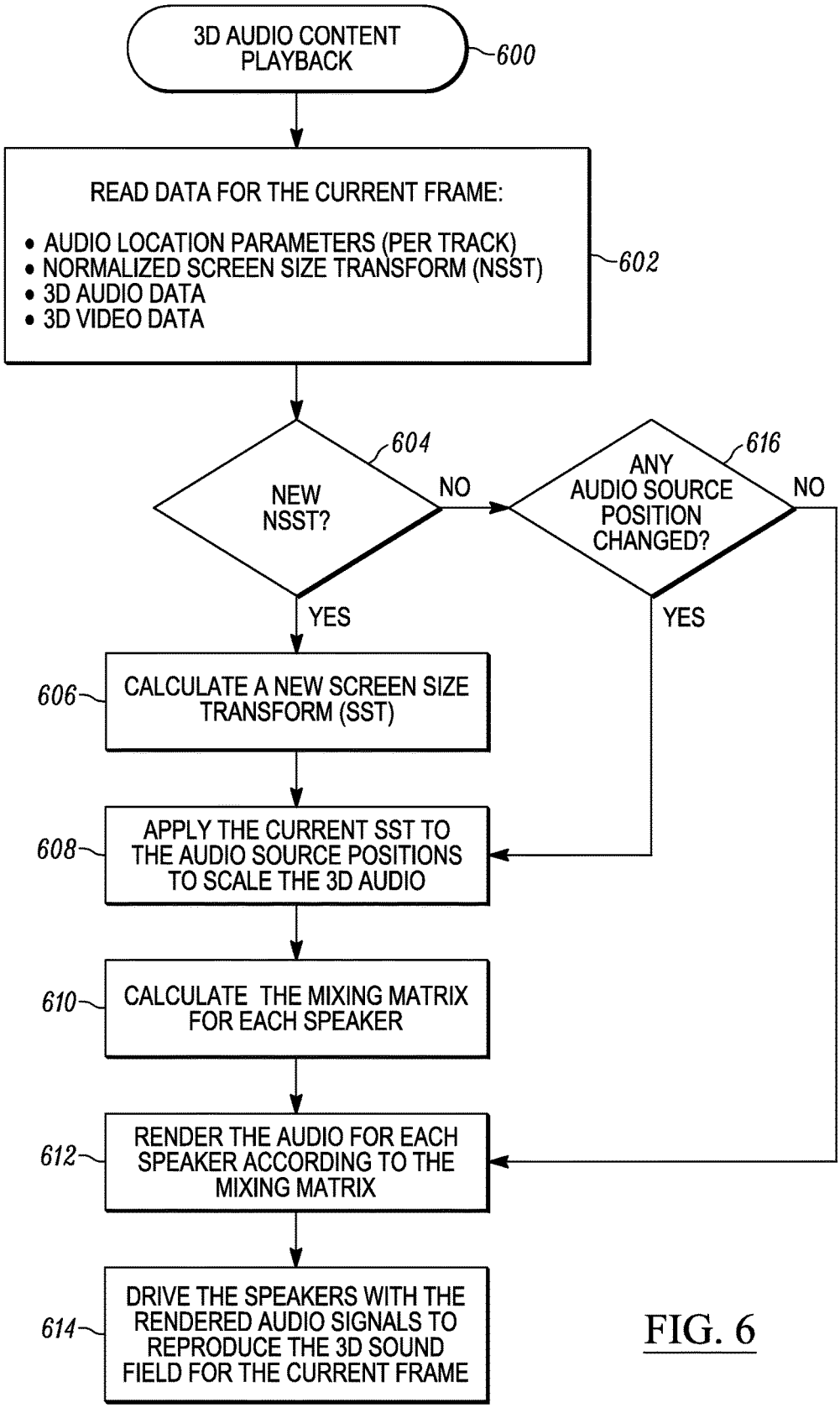
FIG. 6 is a flow chart that illustrates an exemplary embodiment of a 3D audio content playback process.

FIG. 4 is a flow chart that illustrates an exemplary embodiment of a 3D audio configuration process 400, which may be performed to support the 3D audio methodologies described here. FIG. 5 is a flow chart that illustrates an exemplary embodiment of a 3D audio content creation process 500, and FIG. 6 is a flow chart that illustrates an exemplary embodiment of a 3D audio content playback process 600. The various tasks performed in connection with an illustrated process may be performed by software, hardware, firmware, or any combination thereof. For illustrative purposes, the following description of the processes 400, 500, 600 may refer to elements mentioned above in connection with FIGS. 1-3. It should be appreciated that a process described here may include any number of additional or alternative tasks, that the tasks shown in the figures need not be performed in the illustrated order, and that a given process may be incorporated into a more comprehensive procedure or process having additional functionality not described in detail herein. Moreover, one or more of the tasks shown in a given figure could be omitted from an embodiment of the illustrated process as long as the intended overall functionality remains intact.

Referring to FIG. 4, the 3D audio configuration process 400 may be performed by a content developer, a graphics engineer, or the like. Thus, the process 400 could be performed and completed before the associated 3D content is rendered and presented to the user. In this regard, the process 400 may be considered to be an initial process that need not be executed on the fly each time the associated 3D content is played back.

The process 400 may begin by defining the virtual 3D environment for the audio/video content (task 402). Task 402 defines the virtual space by leveraging conventional 3D graphics and video techniques and technologies, which will not be described in detail here. During task 402, characteristics such as height, width, depth, scale, aspect ratio, viewpoint, and viewport are defined. These parameters characterize the world in which the virtual objects will exist, as well as how the world will be rendered to the screen for the observer. The process 400 may also define and create the 3D video objects (task 404) that will reside within the world defined at task 402, and that represent the video content that will be rendered to the screen. In this regard, task 404 may define the 3D models, planes, and shapes corresponding to the video objects. Task 404 creates the 3D video objects in accordance with conventional 3D graphics techniques and methodologies, which will not be described in detail here. Any number of 3D video objects may be generated at task 404, whether or not those video objects have 3D audio associated therewith.

The process 400 may continue by defining acoustic characteristics for all applicable 3D video objects (task 406). It should be appreciated that task 406 need not be performed for 3D video objects that are not "sound generating" objects. Moreover, task 406 need not be performed for certain 3D video objects wherein realistic acoustic characteristics are unimportant or of secondary concern. Task 406 defines acoustic characteristics such that the 3D video objects will have realistic and accurate sound parameters. In this context, task 406 may define the acoustic characteristics to account for parameters such as: acoustic impedance; acoustic reflection; sound absorption; acoustic dampening; frequency response; filtering; or the like. In practice, some or all of the defined acoustic characteristics may be associated with the intended physical properties or nature of the respective virtual objects. For example, if a 3D video object represents a character wearing soft clothing, then the acoustic characteristics may be defined such that the corresponding 3D audio appears to be muffled and has little to no associated sound reflections. In contrast, if a 3D video object represents a robot fabricated from sheets of metal, then the acoustic characteristics may be defined such that the corresponding 3D audio appears to be bright or tinny and has a high amount of associated sound reflections.

Next, the process 400 may assign at least one audio source object to each 3D video object of interest (task 408). As described above, a 3D video object (e.g., a visual character or element) could have one or more audio source objects assigned to it. For example, a 3D video object corresponding to a dog may have two audio source objects assigned thereto: a first audio source object corresponding to the dog's mouth (for voice sounds); and a second audio source object corresponding to the dog's feet (for footstep sounds). In practice, some 3D video objects will have only one audio source object assigned thereto, and some 3D video objects will have no audio source objects assigned thereto (such video objects are "silent" in that they do not generate sound).

For this particular embodiment, each audio source object will have an associated audio track linked to it, but each audio source object need not have a unique and different audio track. Thus, the process 400 assigns and links a respective audio track to each of the audio source objects (task 410), resulting in a plurality of linked audio tracks. The process 400 may result in the creation of an audio-to-video matrix, as described above with reference to FIG. 3. As explained above, the same audio track could be re-used for multiple audio source objects if so desired.

In certain scenarios, a 3D video object may have acoustic characteristics assigned to it in task 406 but no audio source object assigned to it in task 408. An example of this may be a couch in the virtual environment which would have an acoustic absorption characteristic assigned to it, that would affect the way sound from other sources reflects off of it, but no acoustic source of its own.

Referring now to FIG. 5, an iteration of the 3D audio content creation process 500 is performed for each video frame. Thus, the process 500 can be performed on a frame-by-frame basis to generate 3D audio data for each video frame of the corresponding 3D video content. For the example described here, the content creation functionality 302 (see FIG. 3) is responsible for executing the process 500. Moreover, one or more iterations of the process 500 could be executed concurrently with the rendering and presentation of one or more "historical" or "previous" frames of 3D audio/video content.

The illustrated embodiment of the process 500 begins by obtaining the current position and movement vectors for the 3D video objects (task 502). In this regard, task 502 obtains the physical and acoustic directions and trajectories for the graphically depicted video objects. Thus, each iteration of the process 500 is aware of the current audio and video position of each represented video object, along with the orientation of the sound source objects. This information is related to the current state of the 3D audio/video content and, as such, may be based upon or determined by a number of previously processed and rendered video frames. In certain implementations, the process 500 may utilize one or more artificial intelligence agents that influence the physical reactions, movement, change of directions, and/or other physical characteristics of the virtual objects.

The process 500 also calculates the normalized screen size transform, based on the current state of the video content (task 504). Task 504 is performed as necessary, e.g., if there have been changes since the last frame. The normalized screen size transform was described above with reference to the 3D audio/video data 310 (see FIG. 3). In practice, the normalized screen size transform will be influenced by the dimensions and scaling of the visually represented virtual environment. For example, the normalized screen size transform may be calculated based on the dimensions of the virtual 3D portal, the current zoom perspective of the video content, and the like. Thus, the normalized screen size transform is computed on a frame-by-frame basis to contemplate ongoing changes to the visual perspective, zoom levels, scene changes, etc. Notably, the process 500 calculates the normalized screen size transform in a manner that does not rely on the actual physical display screen size (i.e., the real world dimensions of the viewport). Thus, the process 500 need not have any prior knowledge of the display screen dimensions.

As a preferred (but optional) step, the process 500 performs simulated physics processing on the virtually represented physical objects (task 506). In practice, task 506 may utilize one or more physics engines, physics simulation algorithms, and/or other techniques to mimic real world physics and to predict how the virtually represented objects might interact with one another. In this regard, a physics engine could apply effects such as gravity, friction, momentum, velocity vectors, inertia, and the like. Task 506 may also generate acoustic effects and/or other interactive audio content that is caused or initiated by interaction between at least two of the 3D video objects. For example, if a graphical representation of a rock bounces off a graphical representation of a brick wall, then sound will be generated. This type of predictive sound generation, which responds to video object interaction, is particularly desirable in real-time 3D applications such as interactive video games.

The process 500 then proceeds by generating the 3D audio/video data to be used for presenting the content to the user. In this regard, the process 500 renders the video content for the frame (task 508) using conventional 3D video rendering techniques and methodologies. The process 500 also compiles and mixes the audio (task 510) for the current frame and compiles the various audio source locations for the 3D video objects (task 512). Tasks 510 and 512 are performed to process all of the sound-generating objects for the current frame, including active sound-generating objects (e.g., voices, a car engine, and gunfire), passive sound-generating objects (e.g., sound effects or acoustic reflections of sound off of surfaces), and sound sources associated with object interactions (e.g., collisions, bounces, and ricochets). The various audio tracks are compiled and mixed such that the 3D audio can be accurately rendered during playback. Upon completion of tasks 510 and 512, the process 500 will have the per-track audio information and the locations of the different audio sources for the current video frame.

Next, the process 500 writes the per-frame 3D audio/video data to memory (task 514). As depicted in FIG. 5, task 514 obtains and writes the rendered 3D video data in association with the rendered 3D audio data. Task 514 also obtains and writes the normalized screen size transform and the audio location parameters for the current frame. The audio location parameters are used when rendering the sound field in the playback. Task 514 may also write other data to memory, as appropriate for the particular embodiment or application. In certain applications, such as video games, task 514 writes the data to RAM to facilitate immediate access and real-time rendering of the spatial sound field during playback. In other applications, such as recorded video, task 514 writes the data to a mastering file, a nonvolatile storage media or memory element, or the like (to facilitate on-demand rendering of the 3D spatial sound field during playback at a later time). The process 500 is repeated (if needed) for the next video frame in sequence. Thus, an iteration of the process 500 is executed for each video frame until no frames remain.

Referring now to FIG. 6, an iteration of the 3D audio content playback process 600 is performed for each video frame. Thus, the process 600 can be performed on a frame-by-frame basis to generate the 3D audio sound field for each video frame of the corresponding 3D video content. For the example described here, the content playback functionality 304 (see FIG. 3) is responsible for executing the process 600. Moreover, this example assumes that the presentation device is already aware of certain device-specific parameters (e.g., the physical dimensions or size of the display screen and the configuration of the array of speakers).

The process 600 may begin by reading the necessary data for the current frame (task 602). For this example, the data read at task 602 corresponds to the data written at task 514 of the 3D audio content creation process 500. Accordingly, task 602 may read the following data, without limitation: the per-track audio location parameters; the normalized screen size transform; the 3D audio data; and the 3D video data.

The process 600 checks whether the normalized screen size transform (NSST) read at task 602 is new (query task 604). In other words, query task 604 checks whether the NSST for the current video frame is different than the NSST for the previous video frame. Although the NSST will usually be stable and steady from one frame to another, if the video content zooms in, zooms out, or changes scenes, then the NSST will be updated to reflect the changes to the virtual 3D portal size. If the current NSST represents a changed transform (the "Yes" branch of query task 604), then the process 600 calculates a new screen size transform (SST) to be used for the current frame (task 606). For this implementation, the SST is defined as follows:

$$SST = \text{Screen Size} \times NSST = \frac{\text{Screen Size}}{Wzp}$$

In this expression, "Screen Size" refers to the actual size (width) of the display element used by the presentation device, which also corresponds to the 3D video viewport. The term Wzp refers to the virtual width at the zero plane in view space units (the distance that the horizontal frustum angle subtends at the 3D zero plane). From the above expression, it can be seen that $$SST = \frac{1}{Wzp}.$$

The SST represents device-specific scaling of the 3D audio sound field. As described above, the NSST is calculated during the content creation process without any a priori knowledge of the actual screen size (viewport dimensions). Accordingly, task 606 introduces scaling based on the SST, which in turn is influenced by the actual screen size. The process 600 may continue by applying the calculated SST to the audio source positions to scale the 3D audio in an appropriate manner (task 608). Thus, the process 600 applies certain device-specific parameters to the 3D audio data (which was obtained at task 602) to obtain transformed 3D audio data that is scaled to the host presentation device. Consequently, the real world acoustic sound field is scaled and dimensioned by transforming the view space by the SST. In turn, this translates the distance and size of objects relative to one another and relative to the user from the view space to the real world, scaled as needed for the viewer's actual display screen.

The 3D audio content playback process 600 continues by calculating the audio mixing matrix for each speaker in the array of speakers used by the presentation device (task 610). Task 610 may utilize a spatial audio methodology, such as wave field synthesis, to determine the manner in which each individual speaker must be driven to create the desired 3D sound field. In certain embodiments, task 610 performs wave field synthesis on a plurality of audio tracks to generate wave field synthesis coefficients. These coefficients can be adjusted or scaled as needed to accommodate the device-specific parameters such as display screen size. Task 610 mixes the audio tracks corresponding to the various audio source objects based on the desired volume, virtual locations, etc. In this regard, task 610 generates the 3D audio data that represents the desired 3D spatial sound field for the current frame of 3D video content. The mixing matrix can then be used to render the audio channel for each individual speaker (task 612). Task 612 generates the different audio signals (e.g., voltage magnitudes, phase, and delay) that are fed to the speakers used by the presentation device. In this regard, the rendered audio signals are used to drive the speaker array in a controlled manner to reproduce the desired 3D sound field for the current video frame (task 614).

Referring back to query task 604, if the NSST read at task 602 is the same as the most recently processed NSST (the "No" branch of query task 604), then the process 600 determines whether any audio source position has changed, relative to the last video frame (query task 616). In other words, query task 616 checks whether the virtual position of any audio source object has moved. Note that the "Yes" branch of query task 616 is followed even if the position of only one audio source object has changed. If all of the audio source objects have remained stationary (the "No" branch of query task 616), then the process 600 proceeds directly to task 612 to render the audio for the speakers. In this scenario, the previously used SST remains valid and the virtual locations of the audio sources remain in their previous locations. Accordingly, the spatial audio information remains stable when the NSST and audio source positions are unchanged. In this case, the wave field synthesis coefficients do not need to be recalculated, merely reused from the previous frame and fed the new audio information.

If one or more audio source positions have changed since the last frame (the "Yes" branch of query task 616), then the process 600 leads to task 608 and continues as described above. In this scenario, the current SST is applied to the new set of audio source positions, such that the rendered audio will accurately reflect the changed audio source position(s). Note that the query task 616 and the process flow stemming from query task 616 will only be executed when the current NSST is the same as the NSST from the previous frame. In this regard, if the NSST has changed then at least one audio source position is likely to change. Accordingly, the check made during query task 616 is not necessarily performed if the process 600 determines that the NSST has changed.

The process 600 is repeated (if needed) for the next video frame in sequence. Thus, an iteration of the process 600 is executed for each video frame until no frames remain.

The 3D audio processing methodology described here scales the synthesized sound field (which is a physical phenomenon) to accommodate different display screen sizes as needed. Thus, if a sound-generating 3D video object appears at a virtual distance of five feet behind a very large monitor, then the corresponding 3D audio is scaled such that the user perceives the audio source object to be about five feet behind the display screen. If, however, the same 3D video content is displayed on a small monitor (e.g., a laptop computer display), then the 3D video object may only appear at a virtual distance of eight inches behind the display screen. The 3D audio scaling technique presented here will adjust the generated sound field in accordance with the display screen size such that the user will perceive the audio source object to be about eight inches behind the smaller display screen. Without such 3D audio scaling, the 3D audio will not be realistically rendered for presentation in conjunction with different display screen sizes. The techniques and technologies described here enable the presentation device to perform a 3D audio transform between the virtual 3D portal (which is independent of actual display screen size) and the physical display element (i.e., the real world viewport that is utilized to represent the virtual 3D portal).

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing," or any other variation thereof, are intended to cover a non-exclusive inclusion, such that a process, method, article, or apparatus that comprises, has, includes, or contains a list of elements does not include only those elements but may include other elements not expressly listed or inherent to such process, method, article, or apparatus. An element preceded by "comprises a," "has a," "includes a," "contains a," or the like does not, without more constraints, preclude the existence of additional identical elements in the process, method, article, or apparatus that comprises, has, includes, or contains the element. The terms "a" and "an" are defined as one or more unless explicitly stated otherwise herein. The terms "substantially," "essentially," "approximately," "about," or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, tangible and non-transient mediums such as a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract associated with this document is provided to allow the reader to quickly ascertain the nature of the technical disclosure. It is submitted with the understanding that it will not be used to interpret or limit the scope or meaning of the claims. In addition, in the foregoing description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the detailed description, with each claim standing on its own as a separately claimed subject matter.

What is claimed is:

1. A method of processing three-dimensional (3D) audio for a 3D video content having 3D video objects, the method comprising:

assigning at least one audio source object to at least one 3D video object in the 3D video content;

linking, to the at least one audio source object, at least one audio track, resulting in a plurality of linked audio tracks;

performing a wave field synthesis on the plurality of linked audio tracks to generate 3D audio data representing a 3D spatial sound field corresponding to the 3D video content, wherein a performance of the wave field synthesis includes using a device-specific screen size transform matrix produced from a normalized screen size transform matrix.

2. The method of claim 1, further comprising:

calculating the normalized screen size transform matrix for the 3D audio data, based on dimensions of a virtual 3D portal of the 3D video content.

3. The method of claim 1, wherein the performing comprises performing the wave field synthesis on a frame-by-frame basis to generate the 3D audio data for each video frame of the 3D video content.

4. The method of claim 1, further comprising:

writing the 3D audio data in association with corresponding 3D video data.

5. The method of claim 4, wherein the writing comprises writing the 3D audio data to a random access memory (RAM) element to facilitate real-time rendering of the 3D spatial sound field.

6. The method of claim 4, wherein the writing comprises writing the 3D audio data to a nonvolatile memory element to facilitate on-demand rendering of the 3D spatial sound filed.

7. The method of claim 1, further comprising:

compiling and mixing the plurality of linked audio tracks, wherein the 3D audio data is influenced by the compiling and mixing.

8. The method of claim 1, further comprising:

compiling and determining audio source locations for the 3D video objects, wherein the 3D audio data is influenced by the compiling and determining.

9. The method of claim 1, wherein the 3D audio data corresponds to one audio stream for at least one of the at least one audio source object tied to a 3D video object.

10. The method of claim 1, wherein the 3D audio data represents the 3D spatial sound field in a manner that is independent of physical display screen dimensions of a presentation device.

11. The method of claim 1, wherein the 3D audio data represents the 3D spatial sound field in a manner that is independent of a speaker configuration of a presentation device.

12. The method of claim 1, further comprising:

defining acoustic characteristics for at least some of the 3D video objects.

13. A tangible and non-transitory computer readable medium having computer-executable instructions stored thereon and capable of performing a method when executed by a processor, the method comprising:

assigning at least one audio source object to at least one 3D video object in a 3D video content;

linking, to the at least one audio source object, at least one audio track, resulting in a plurality of linked audio tracks;

performing a wave field synthesis on the plurality of linked audio tracks to generate 3D audio data representing a 3D spatial sound field corresponding to the 3D video content, wherein a performance of the wave field synthesis includes using a device-specific screen size transform matrix produced from a normalized screen size transform matrix.

14. The computer readable medium of claim 13, wherein the method performed by the computer-executable instructions further comprises:

calculating the normalized screen size transform matrix for the 3D audio data, based on dimensions of a virtual 3D portal of the 3D video content.

15. The computer readable medium of claim 13, wherein the method performed by the computer-executable instructions further comprises:

compiling and determining audio source locations for the 3D video objects, wherein the 3D audio data is influenced by the compiling and determining.

16. The computer readable medium of claim 13, wherein the method performed by the computer-executable instructions further comprises:

defining acoustic characteristics for at least some of the 3D video objects.

17. A computing system comprising:

at least one processor; and memory having computer-executable instructions stored thereon that, when executed by the at least one processor, cause the computing system to:

assign at least one audio source object to at least one three-dimensional (3D) video object in a 3D video content;

link, to the at least one audio source object, at least one audio track, resulting in a plurality of linked audio tracks;

perform a wave field synthesis on the plurality of linked audio tracks to generate 3D audio data representing a 3D spatial sound field corresponding to the 3D video content, wherein a performance of the wave field synthesis includes using a device-specific screen size transform matrix produced from a normalized screen size transform matrix.

18. The computing system of claim 17, wherein the computer-executable instructions, when executed by the at least one processor, cause the computing system to:

calculate the normalized screen size transform matrix for the 3D audio data, based on dimensions of a virtual 3D portal of the 3D video content.

19. The computing system of claim 17, wherein the computer-executable instructions, when executed by the at least one processor, cause the computing system to:

compile and determine audio source locations for the 3D video objects, wherein the 3D audio data is influenced by the compiling and determining.

20. The computing system of claim 17, wherein the computer-executable instructions, when executed by the at least one processor, cause the computing system to:

define acoustic characteristics for at least some of the 3D video objects.

21. A method of processing three-dimensional (3D) audio for a 3D video content having 3D video objects, the method comprising:

obtaining 3D audio data and 3D video data for a frame of the 3D video content;

applying device-specific parameters to the 3D audio data to obtain transformed 3D audio data that is scaled to a host presentation device, the device-specific parameters including a device-specific screen size transform matrix produced from a normalized screen size transform matrix; and processing the transformed 3D audio data to render audio information for an array of speakers associated with the host presentation device.

22. The method of claim 21, wherein:

the processing results in a respective channel of the audio information for at least one speaker in the array of speakers.

23. The method of claim 21, wherein the 3D audio data comprises a plurality of wave field synthesis coefficients that represent a 3D spatial sound field.

24. The method of claim 21, further comprising:

obtaining the normalized screen size transform matrix in association with the 3D audio data for the frame; and calculating the device-specific screen size transform matrix from the normalized screen size transform matrix and a physical screen size of the host presentation device.

25. The method of claim 24, wherein the device-specific parameters define the physical screen size of the host presentation device.

26. The method of claim 24, wherein characteristics of the normalized screen size transform matrix are influenced by dimensions of a virtual 3D portal for the frame of the 3D video content.

27. The method of claim 21, wherein the device-specific parameters define a speaker configuration for the array of speakers.

28. The method of claim 27, wherein the speaker configuration identifies a number of speakers contained in the array of speakers.

29. The method of claim 27, wherein the speaker configuration identifies positions of speakers contained in the array of speakers.

30. The method of claim 21, wherein the processing the transformed 3D audio data comprises:

calculating an audio mixing matrix for at least one speaker contained in the array of speakers; and rendering the audio information for the at least one speaker in accordance with the audio mixing matrix.

31. A tangible and non-transitory computer readable medium having computer-executable instructions stored thereon and capable of performing a method when executed by a processor, the method comprising:

obtaining three-dimensional (3D) audio data and 3D video data for a frame of a 3D video content;

applying device-specific parameters to the 3D audio data to obtain transformed 3D audio data that is scaled to a host presentation device, the device-specific parameters including a device-specific screen size transform matrix produced from a normalized screen size transform matrix; and processing the transformed 3D audio data to render audio information for an array of speakers associated with the host presentation device.

32. The computer readable medium of claim 31, wherein the 3D audio data comprises a plurality of wave field synthesis coefficients that represent a 3D spatial sound field.

33. The computer readable medium of claim 31, wherein the method performed by the computer-executable instructions further comprises:

obtaining the normalized screen size transform matrix in association with the 3D audio data for the frame; and calculating the device-specific screen size transform matrix from the normalized screen size transform matrix and a physical screen size of the host presentation device.

34. The computer readable medium of claim 31, wherein the processing the transformed 3D audio data comprises:

calculating an audio mixing matrix for at least one speaker contained in the array of speakers; and rendering the audio information for the at least one speaker in accordance with the audio mixing matrix.

35. An audio/video presentation device comprising:

an array of speakers;

at least one processor; and memory having computer-executable instructions stored thereon that, when executed by the at least one processor, cause the audio/video presentation device to:

obtain three-dimensional (3D) audio data and 3D video data for a frame of a 3D video content;

apply device-specific parameters to the 3D audio data to obtain transformed 3D audio data that is scaled to the presentation device, the device-specific parameters including a device-specific screen size transform matrix produced from a normalized screen size transform matrix; and process the transformed 3D audio data to render audio information for the array of speakers.

36. The audio/video presentation device of claim 35, wherein the at least one processor is configured to process the transformed 3D audio data to result in a respective channel of the audio information for at least one speaker in the array of speakers.

37. The audio/video presentation device of claim 35, wherein the 3D audio data comprises a plurality of wave field synthesis coefficients that represent a 3D spatial sound field.

38. The audio/video presentation device of claim 35, wherein the computer-executable instructions, when executed by the at least one processor, cause the audio/video presentation device to:

obtain the normalized screen size transform matrix in association with the 3D audio data for the frame; and calculate the device-specific screen size transform matrix from the normalized screen size transform matrix and a physical screen size of the audio/video presentation device.

39. The audio/video presentation device of claim 38, wherein the device-specific parameters define the physical screen size of the audio/video presentation device.

40. The audio/video presentation device of claim 38, wherein characteristics of the normalized screen size transform matrix are influenced by dimensions of a virtual 3D portal for the frame of the 3D video content.

41. The audio/video presentation device of claim 35, wherein the device-specific parameters define a speaker configuration for the array of speakers.

42. The audio/video presentation device of claim 35, wherein the at least one processor is configured to process the transformed 3D audio data by:

calculating an audio mixing matrix for at least one speaker contained in the array of speakers; and rendering the audio information for the at least one speaker in accordance with the audio mixing matrix.

* * * * *